United States Patent [19]

Hartwig et al.

[11] Patent Number: 4,853,554

[45] Date of Patent: Aug. 1, 1989

[54] STARTING DEVICE

[75] Inventors: Carl S. M. Hartwig, Täby; Sven H. Johansson, Åmål, both of Sweden

[73] Assignee: Institut Cerac S.A., Ecublens, Switzerland

[21] Appl. No.: 693,107

[22] Filed: Jan. 22, 1985

[30] Foreign Application Priority Data

Jan. 26, 1984 [CH] Switzerland ..... 351/84

[51] Int. Cl.[4] ..... F02N 11/04

[52] U.S. Cl. ..... 290/46; 318/801

[58] Field of Search ..... 290/46, 10, 22, 31; 310/64, 65, 68 D; 318/801

[56] References Cited

U.S. PATENT DOCUMENTS

| | | | |
|---|---|---|---|
| 3,323,032 | 5/1967 | Agarwal | 318/801 |
| 3,527,971 | 9/1970 | Means | 310/68 D |
| 3,553,505 | 1/1971 | Sato | 310/68 D |
| 3,562,564 | 2/1971 | Potter | 310/68 D |
| 3,731,169 | 5/1973 | Burgtiolte et al. | 318/801 |
| 3,858,069 | 12/1974 | Kuter et al. | 310/68 D |
| 4,459,536 | 7/1984 | Wirtz | 290/46 |

*Primary Examiner*—David Smith, Jr.

*Attorney, Agent, or Firm*—Eric Y. Munson

[57] ABSTRACT

A starting device for an automobile motor in which an asynchronous motor (23) is used both as starting motor and generator. A number of solid state switches (10), forming part of an inverter, is arranged on a metal bar (7) extending along the stator (4) of the motor. The metal bar is connected to one terminal of a voltage supply (21). The stator conduits (9) are connected to a solid state switch and to the other terminal of the voltage supply.

4 Claims, 2 Drawing Sheets

STARTING DEVICE

The present invention relates to a starting device for an automobile motor.

In order to make possible a decrease in energy consumption and pollution of the environment it has been suggested to use an automatic stop restart procedure by means of which idling of the automobile motor is avoided, see DE No. 27 36 185.

The frequent restarts which will be the result particularly in urban areas increases the requirements on reliability and improved wear resistance. The present invention aims at providing a starting device which is reliable, has good wear resistance and is rugged so that it can be directly connected to the crank shaft of the automobile motor if desired and also be used as generator which might lead to speeds of 5000–10000 rpm. The direct connection to the crank shaft makes it possible to use the starting motor as drive motor over substantial distances, of the order of some hundreds of meters. This makes it possible to drive a car completely with the starting motor in, for instance, underground parking places where it is desirable to avoid exhaust gases. This is obtained with a starting device as claimed in the appended claims.

An embodiment of the invention is described below with reference to the accompanying drawings in which FIG. 1 shows a section through a starting device according to the invention.

Figure 1:
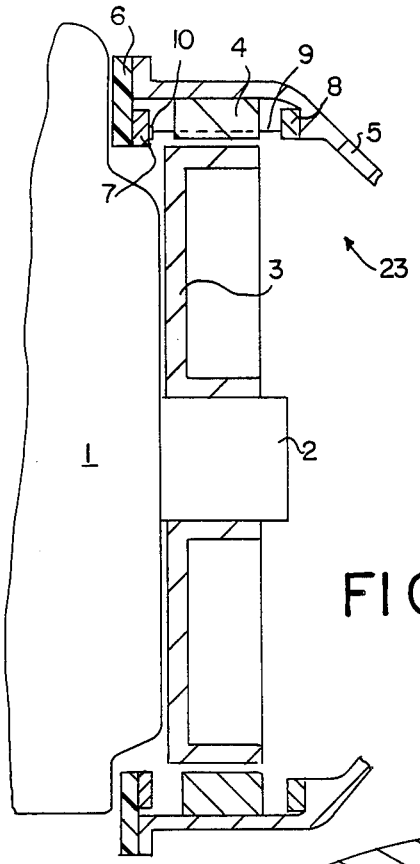
Figure 3:
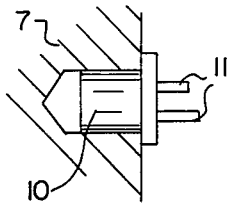
FIG. 3 shows the mounting of a solid state switch.
Figure 2:
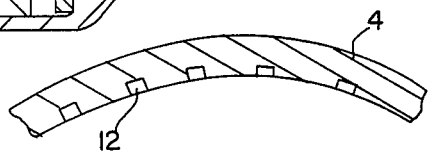
FIG. 2 shows a section through a part of the stator of the starting motor.

In FIG. 1 is shown an automobile motor 1 provided with a crank shaft 2 to which a flywheel 3 is secured. The flywheel is also the rotor of an asynchronous motor 23. The motor is of the squirrel cage type. A stator 4 provided with slots 12 extends around rotor 3. The stator is secured to a cover 5 which together with a ring 6 of insulating material is secured to the motor 1. Conduits 9 are positioned in slots 12. Preferably each slot contains only one conduit which has been molded in situ in the slot of the stator. The conduit is provided with insulation against the stator. A metal bar 7 extends along the stator and is mounted on ring 6. Metal bar 7 is provided with a number of solid state switches 10 which could be mounted as shown in FIG. 3. A metal ring 8 is mounted on cover 5. Rings 7 and 8 are connected to either terminal of a voltage supply 21. The solid state switch is in the shown example a transistor. In this case either the emitter or the collector is in direct contact with metal bar 7 depending on where the switch is incorporated relative to motor 23 and voltage supply 21. The base and collector or emitter are then connected to the legs 11 of the switch. Conduit 9 is connected to one of the legs of switch 10 and to metal ring 8.

Figure 4:
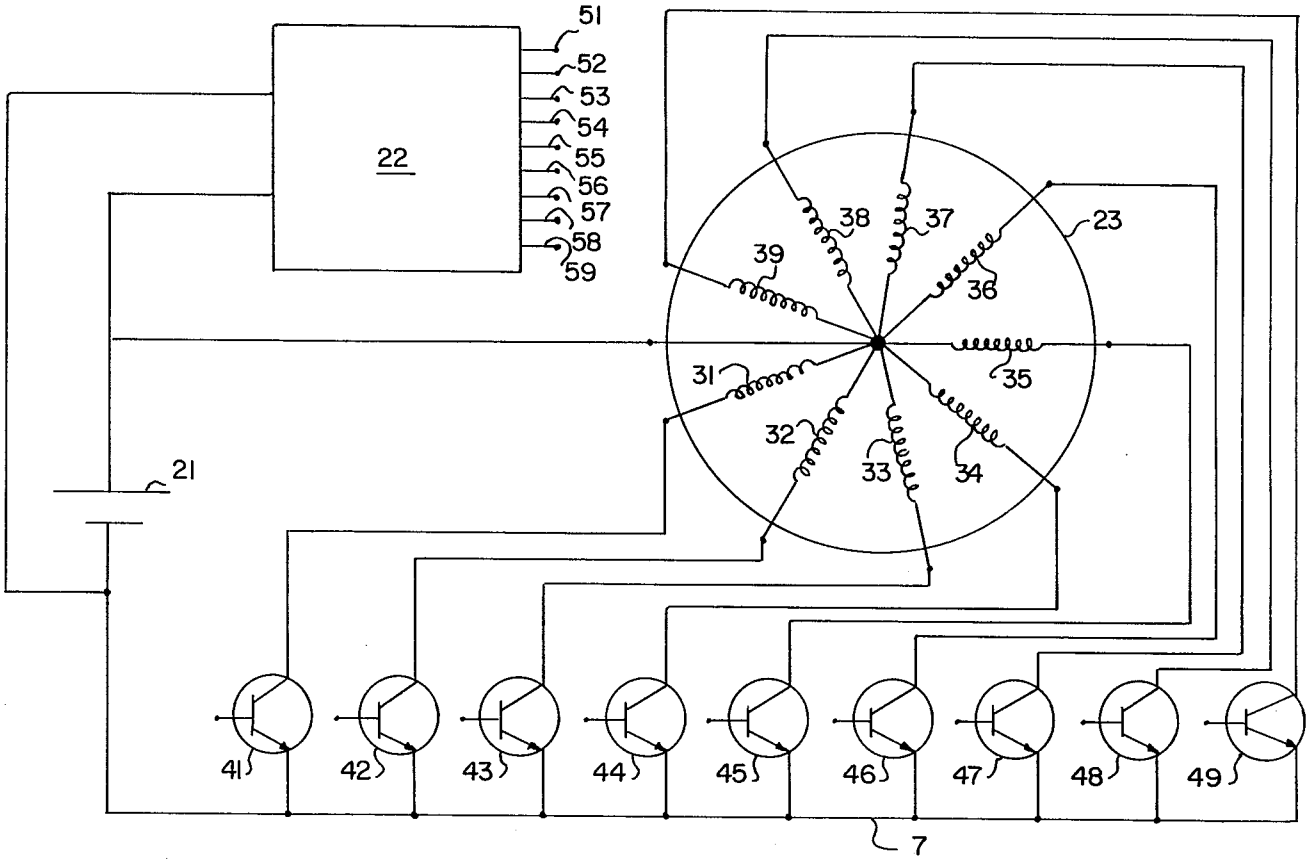
FIG. 4 shows a circuit diagram of the starting device.

The motor shown in FIG. 4 is an asynchronous motor having nine phases. The positive terminal of voltage supply 21 is connected to the common point of phase conduits 31–39. The other ends of the phase conduits are connected via solid state switches 41–49 to the negative terminal of voltage supply 21. The device also comprises a logic unit 22 having a number of outputs 51–59. These outputs are connected to the bases of switches 41–49. The speed of the motor 23 is controlled by the frequency of the output signal circulating between outputs 51–59. This circulating output signal could be obtained by means of a shift register in logic unit 22. Since the circulating output signal causes switches 41–49 to close sequentially a rotating magnetic field is created in the stator 4 so that the rotor will rotate. By having many phases the characteristics and efficiency of the motor will be comparable to those of a motor driven by a sine wave supply. When the speed of the asynchronous motor is increased, after the automobile motor has started, the asynchronous motor acts as generator. The voltage supply 21 is then recharged under control of the logic unit 22. The speed control can be obtained by using a number of discrete frequencies on the circulating output signal from logic unit 22. In this way the frequency of the supply current to the asynchronous motor is changed in discrete steps. By choosing a comparatively high rotor resistance the asynchronous motor is given a characteristic similar to that of a series motor. This makes it possible to control the motor speed by controlling the frequency of the supply current only. It is thus not necessary to change the applied voltage as is normally required.

We claim:

1. A starting device for an automobile motor comprising a starting motor which is also operable as a generator having a rotor comprising the flywheel of the automobile motor, said flywheel mounted on the crankshaft of the automobile motor, a voltage supply having first and second terminals for said starting motor, a stator for said starting motor surrounding said rotor having a plurality of electrical conduits connected to said voltage supply characterized in that, said starting motor is an asynchronous motor, a metal bar extending along said stator connected to said first terminal of said voltage supply, an inverter having a plurality of solid state switches arranged on said metal bar, and means for coupling each of said electrical conduits between a solid state switch and said second terminal of said voltage supply.

2. A starting device according to claim 1 characterized in that said asynchronous motor (23) has more than three phases.

3. The starting device as claimed in claim 1 wherein said stator has a plurality of spaced slots therein and said electrical conduits are molded in situ in said slots.

4. The starting device as claimed in claim 2 wherein said stator has a plurality of spaced slots therein and said electrical conduits are molded in situ in said slots.

* * * * *